US005435837A

United States Patent [19]

Lewis et al.

[11] Patent Number: 5,435,837

[45] Date of Patent: Jul. 25, 1995

[54] ION GENERATION STRUCTURE IN ENVIRONMENTAL SYSTEMS

[76] Inventors: Keith B. Lewis, 2410 Lambourne Ave., Salt Lake City, Utah 84109; Stewart M. Bradford, 11342 S. Woodhill Dr., Salt Lake City, Utah 84092

[21] Appl. No.: 161,351

[22] Filed: Dec. 6, 1993

[51] Int. Cl.[6] ..... B03C 3/011

[52] U.S. Cl. ..... 96/54; 34/82; 34/480; 55/385.1; 96/58; 361/231

[58] Field of Search ..... 96/55, 57, 58, 63, 54; 95/69, 70; 55/385.1; 34/82, 516, 467, 480; 361/231, 233

[56] References Cited

U.S. PATENT DOCUMENTS

| | | | |
|---|---|---|---|
| 1,791,038 | 2/1931 | Opavsky | 34/516 X |
| 2,406,494 | 8/1946 | Ferris | 34/516 X |
| 2,527,745 | 10/1950 | Lawrence | 34/82 X |
| 4,253,852 | 3/1981 | Adams | 96/58 |
| 4,376,642 | 3/1983 | Verity | 96/58 |
| 4,477,263 | 10/1984 | Shaver et al. | 96/58 X |
| 4,768,126 | 8/1988 | Le Vantine | 361/231 X |
| 5,009,683 | 4/1991 | Sun | 361/231 X |
| 5,236,478 | 8/1993 | Lewis et al. | 34/82 X |
| 5,296,019 | 3/1994 | Oakley et al. | 361/231 X |

FOREIGN PATENT DOCUMENTS

| | | | |
|---|---|---|---|
| 914391 | 1/1963 | United Kingdom | 96/58 |

*Primary Examiner*—Richard L. Chiesa
*Attorney, Agent, or Firm*—M. Ralph Shaffer

[57] ABSTRACT

Ionization systems in and for laundry dryers and other contexts, whereby to neutralize static electricity build-up and acidic conditions, and thereby create environmentally friendly systems for drying clothes and other fabrics, generally prolonging fabric life, reducing particle and lint entrainment, and also reducing if not eliminating acidic conditions in dryers and other environs.

7 Claims, 4 Drawing Sheets

ION GENERATION STRUCTURE IN ENVIRONMENTAL SYSTEMS

FIELD OF INVENTION

The present invention relates to environmental systems and, more particularly, to new and improved structures and systems whereby, through ion generation, acidic conditions, inter-article friction and wear, and particulate-entrainment are all minimized, particularly as concerns laundry dryers; likewise, ambient air quality inside and outside of buildings, et cetera, is preserved if not enhanced.

BACKGROUND AND BRIEF DESCRIPTION OF PRIOR ART

While the present invention is not restricted to considerations as to improvements in the operations of home and commercial laundry dryers, yet a discussion of these will be helpful in suggesting broad ranges of application of the invention.

As to dryers of the type described, these of course are intended to receive washed and rinsed laundry coming from a washing machine. Additives such as soaps, detergents, softeners, and bleaches are used in washers, and traces of these ingredients are contained in the moisture of articles introduced into a receiving dryer. Such additives almost universally are acidic in nature and/or cause a cling of the laundry items as these are tumbled in the dryer. Static cling is frequently encountered as one retrieves articles from the dryer; frequently, anti-static strips are included in the dryer to reduce such static cling. The inter-clothes' friction and acidic condition in normal dryers also cause excess friction between the clothes being dried, producing an abundance of lint production and accumulations, and filter units such as the one shown in the inventors' own U.S. Pat. No. 5,236,478, issued Aug. 17, 1993 and fully incorporated herein by way of reference, indicate a means for drastically reducing the entrainment of lint in conduit venting the dryer to the exterior. Even in the best of cases, there will be some accumulations of lint at the underside of the filter tray used in such filter unit.

It has occurred to the inventors that if conditions in the dryer were enhanced to drastically reduce the production of lint in the first instance, then systems for venting dryers would operate even more effectively. The present invention attacks the problem in a particular manner so as to produce two effects: a reduction in the acidity present in the dryer, and a reduction in the "cling" or static electricity attraction and resultant friction between articles in the dryer as well as between such articles and the dryer walls. No other patent or other art is known which is believed to be directly in point as to the invention at issue.

BRIEF DESCRIPTION OF THE INVENTION

In accordance with the above objectives, the invention utilizes an ion generator, with air molecules and other matter passing through the ion generator being negatively charged, with an air stream being intruduced into a dryer, for example, to neutralize the acidic hydrogen ions present in the dryer, thus drastically reducing the acidity in the dryer and thereby causing the clothing or other articles, as they are dried, to dry free of static electricity. The tumbling of the laundry items progresses more effeciently, with less static cling, and hence with less high-friction rubbing between such articles. This results in a pronounced reduction of lint, which is expelled in any event downstream to a lint trap receiving the exhaust of the dryer. The result is the production of much less lint to entrap, thus permitting the lint trap to operate much longer without cleaning and also preserving the porosity and integrity of the filter tray of the lint trap unit. The structures and system as hereinafter described utilize the above principles to advantage, as will hereinafter be point out. The essential feature is the generation of negative ions, through the production of an electrostatic field in the ion chamber, whereby to direct an ionized air stream into the dryer to neutralize the hydrogen ions and positively charged static electricity within the dryer as to the laundry items contained therein.

OBJECTS

Accordingly, a principal object is to provide a system for improving the efficiency of the operation of dryers in an environmentaly friendly manner.

An additional object is to generate a negative, static-electricity condition for reducing acidity and inter-article friction in particular enclosures, whereby to prolong the wear characteristics of items in such enclosure and reduce the production of lint therefrom.

BRIEF DESCRIPTION OF THE DRAWINGS

The invention may best be understood by reference to the following description, taken in conjunction with the following drawings in which.

DETAILED DESCRIPTION OF PREFERRED EMBODIMENTS

Figure 1:
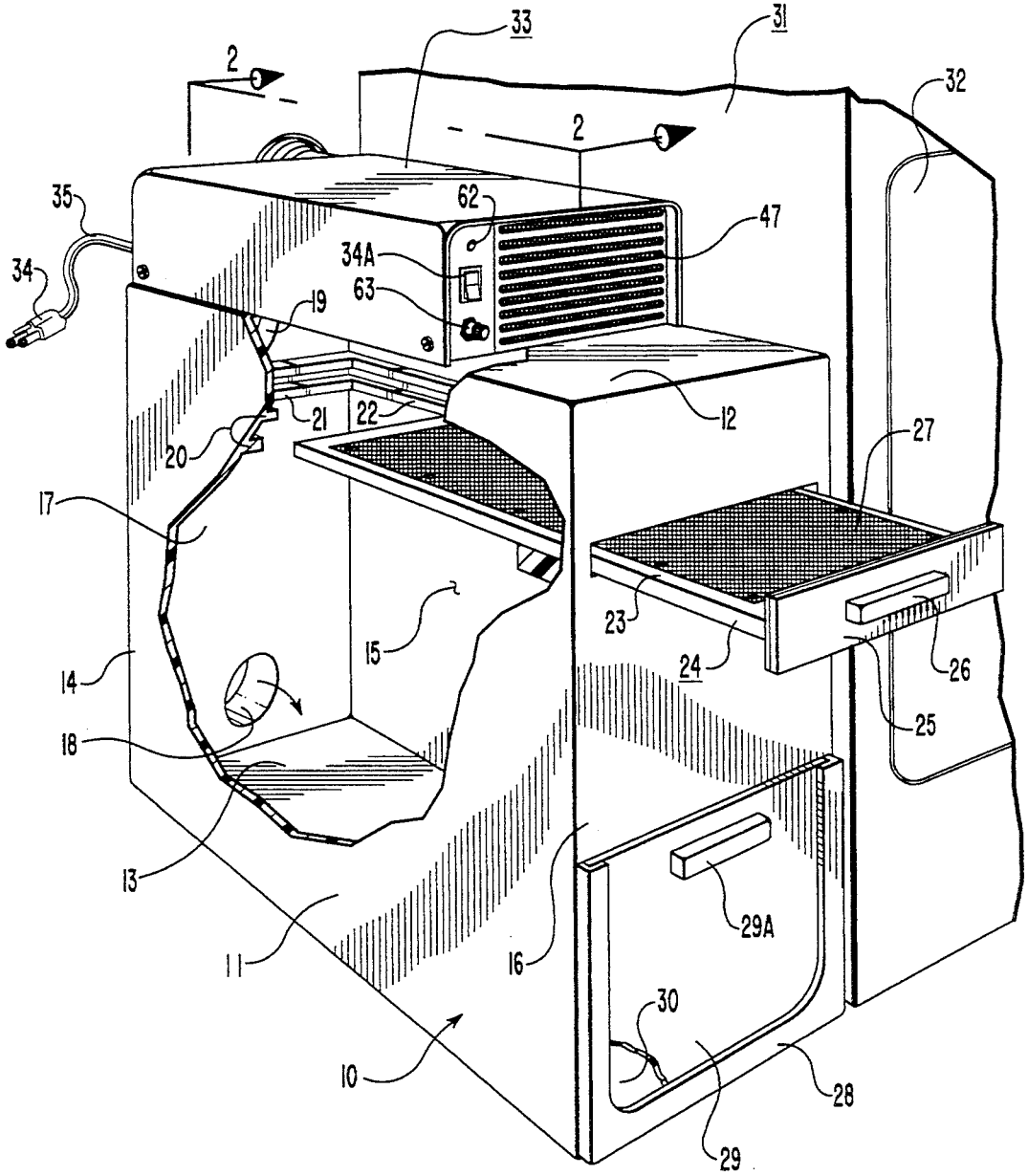
FIG. 1 is a perspective view, partially broken away, of a lint trap and dryer combination incorporating the ion generating structure contemplated in the invention.

In FIG. 1 filter unit 10 is provided cabinet 11. Cabinet 11 is seen to have top 12, bottom 13, opposite sides 14 and 15, and front and rear panels 16 and 17. Rear panel 17 is provided with inlet and outlet ports 18 and 19, preferably located as shown. The interior of the cabinet is fitted with fixed slide rails formed by channel lengths 20, 21 and 22. These channel lengths receive filter tray 23 which is formed by frame 24, the latter being provided with front, drawer-type panel having handle pull 26. The filter tray 23 is provided with mesh 27 tautly secured thereto. Front panel 16 is provided with recessed frame 28 that interiorly slidably receives door 29 that covers access opening 30 of the front panel. Door 29 will preferably include lift handle 29A to accommodate selective lifting of the door, whereby to provide access to to the interior of cabinet 11 for removal of lint accumulations.

The filter unit 10 is provided for a clothes dryer 31, for example, and is connected thereto in a manner hereinafter described. Dryer 31 will be provided with the customary hinged door 32.

Located proximate the filter unit 10 is an ionization unit 33. In FIG. 1 unit 33 sits atop the filter unit 10 and is provided with an AC plug 34 attached to electric cord 35.

Figure 2:
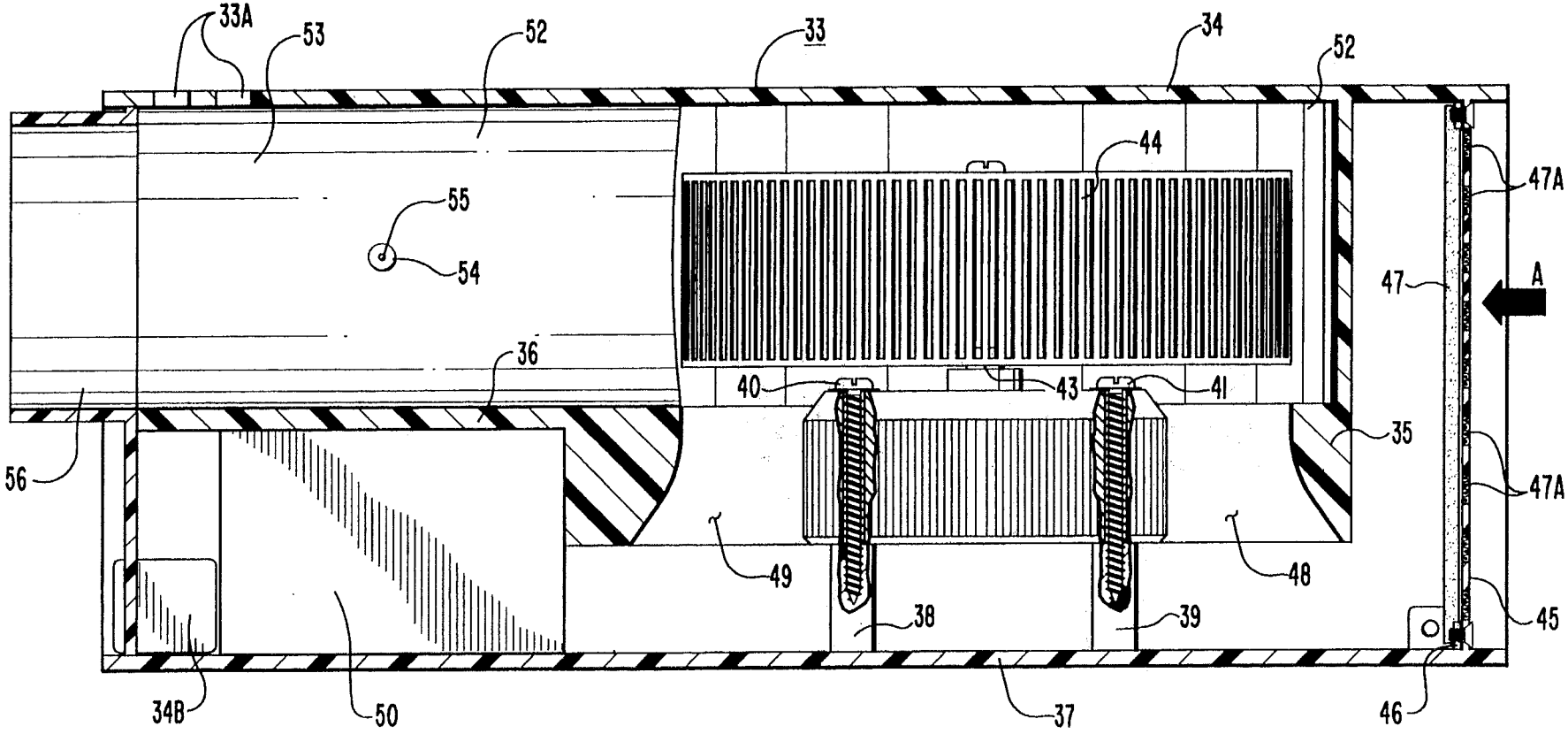
FIG. 2 is an enlarged, longitudinal, vertical section, taken along the line 2—2 in FIG. 1, illustrating the ion generation structure.

Ionization unit 33, see FIG. 2, has housing 34 provided with interior partitions 35 and 36. Housing lower panel 37 is provided with upstanding, internally threaded bosses 38 and 39 which receive mounting screws 40 and 41 for securing electric motor 42, see FIG. 4, in place as shown. Motor 42 includes shaft 43 that is mounted to and drives squirrel cage fan 44. The housing 34 has an open front face 45 that is supplied and a screen or vent 47A and filter securement structure 46 releasably securing airpassage filter 47 in place. Air admittance passageways 48 and 49, cooperating with motor 42 and lead to the squirrel cage blower fan 44, are indicated as shown. An electrical power pack 50 is provided, the same being provided with electrical input plug connector 34B accommodating its cord 35. The same can be housed beneath partition 36. Ionization chamber 52 has opening 53 and is provided with opposite insulator mounts 54 for mounting transverse ionization wire 55. An outlet port 56 communicates with opening 53. Where desired, vent slots 33A may be included for the purpose of directing a portion of the ionized output air to a room enclosure, by way of example.

Figure 3:
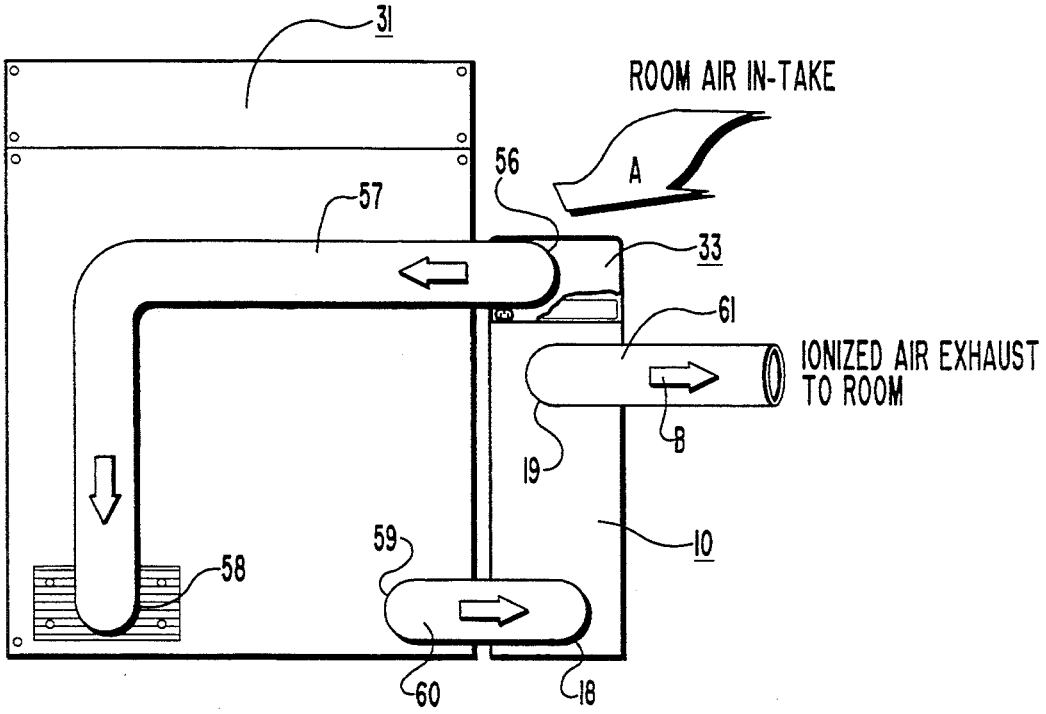
FIG. 3 is a rear elevation in reduced scale of the structure shown in FIGS. 1 and 2.

FIG. 3 illustrates that room air intake at A, see also FIG. 2, proceeds through filter 47 into the ionization unit 33. Conduit 57 is attached to outlet port 56 of the ionization unit and attaches to the customary dryer intake vent or inlet port provided thereat, at 58, in FIG. 3. The outlet of the dryer at 59 is provided with conduit 60 leading to inlet port 18 of the filter or filter trap unit 10. Outlet port 19 of filter unit 10 can be provided with ductwork 61 leading either to a building exhaust vent, or even to a room interior as indicated.

Figure 4:
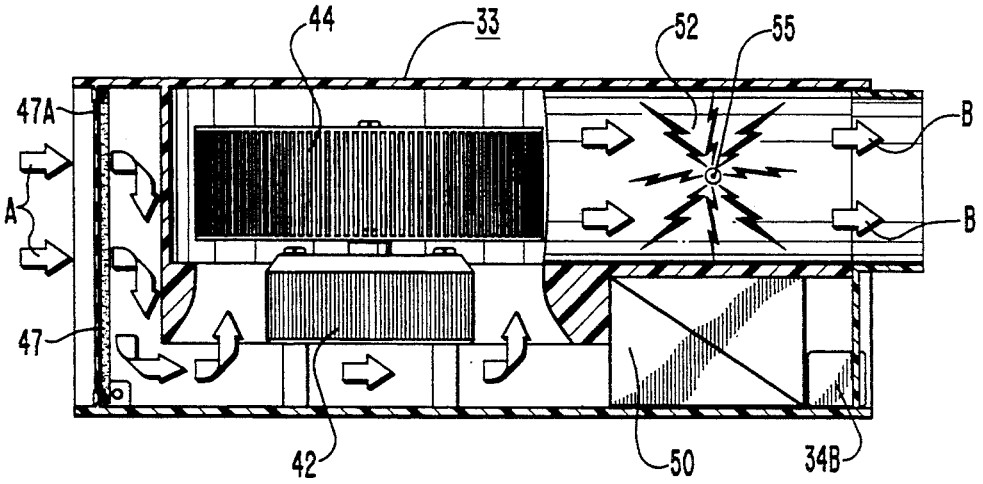
FIG. 4 is a reverse side elevation, broken away, and showing the air-flow pattern within the ion generation structure.

FIG. 4 illustrates the operation and air-flow relative to the ionization unit 33. Thus, intake air at A passes through filter 47 and interiorly flows in the direction of the arrows into the interior of the squirrel cage fan at 44, whereat it is expelled under pressure into the ionization chamber 52. The electrostatic electrical field set up by ionization wire 55 charges air-flow constituents negatively, which air flow proceeds along arrows B to enter the dryer. Such ionized airflow acts to neutralize clothes's static electricity within the dryer and neutralizes acidic conditions therein, as occasioned by the usual residual detergents and additives left in the rinse cycle of the clothes, whereby to reduce inter-article friction among and between fabric articles in the dryer, thereby reducing the production of lint therein. Thus, the ionization produced by the unit herein, effectively de-ionizes normally occuring ions within the dryer so as to produce, over-all, a de-ionizing effect as to the electrostatic condition both within the dryer and air expelled therefrom. Lint expelled from the exhaust port of the dryer is dramatically reduced, and lint trap accumulations are correspondingly reduced, particularly at the area of the filter screen. The resultant exhaust air passing through the screen is virtually lint free, and allows for clean air flow either out of the building, hence enhancing the environment, or simply provides for clean and de-ionized airflow into a room area.

Figure 5:
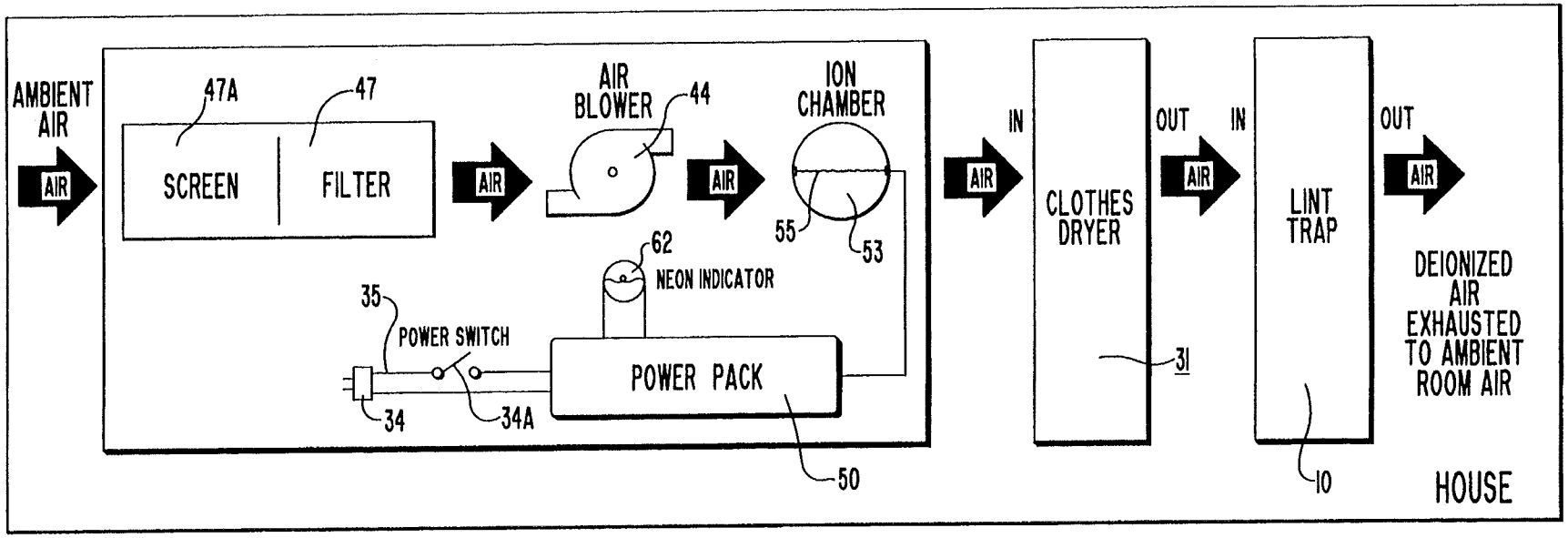
FIG. 5 represents a diagrammatic flow sheet of the invention.
Figure 6:
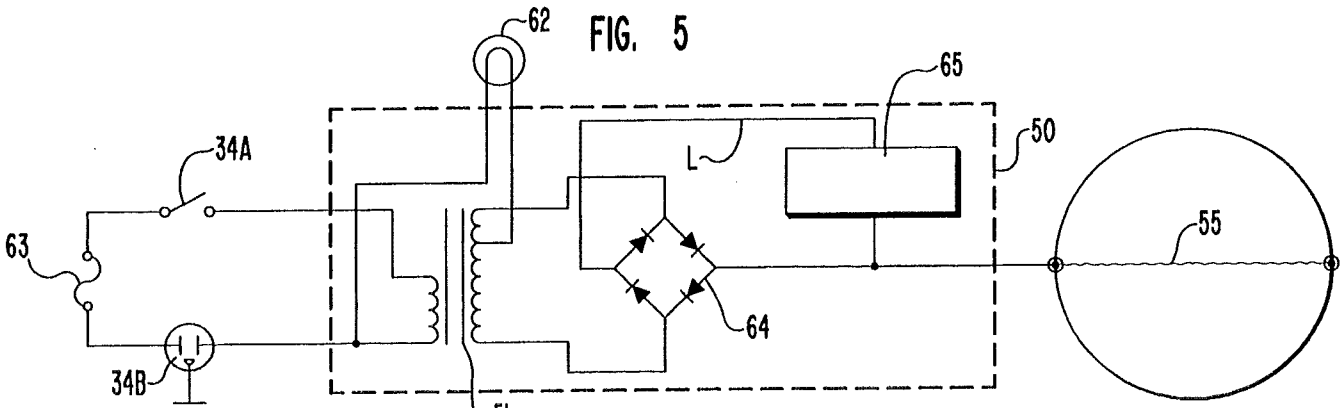
FIG. 6 is an electrical schematic representative of a circuit that may be employed to negatively charge the transverse wire or other object of the ion generator.

FIG. 5 is a block-diagram flow chart illustrating the operation of the over-all system. Ambient air enters through the screen 47A, when employed, and through filter 47 into the air blower comprising squirrel cage fan 44. From there the air passes through the electrostatic field generated by the ionization chamber at 53. The latter is powered by power pack 50, including step-up transformer 51. Once air passes through the ion chamber it enters into the laundry or clothes dryer 31, to be expelled therefrom into lint trap unit 10. From that point, clean de-ionized air enters a room area or is exhausted to the exterior.

FIG. 5 is a schematic diagram of a representative electrical circuit that can be used for the ionization function. Electrical plug connector 34B may be provided with protective fuse circuit and be provided with an on-off switch 34A. Step-up transformer 51 is indicated, plus an indication that a neon indicator light 62, indicating present operation of the system, may be incorporated, see also FIG. 1. Bridge rectifier at 64 converts the transformer output boltage to pulsating DC, which can be filtered by a suitable L-C, i.e. inductance-capacitance, filter circuit such that a desirably smoothed output voltage is provided, the negative side being directly connected to the ionization wire 55, and the positive side remaining floating. A series of electrical leads L connect the circuit elements together.

The ultimate result is an ionization unit that serves to de-ionize the interior condition of the dryer, whereby to reduce internal friction in the dryer, reduce "cling" between laundry items and also between such items and the interior walls of the dryer, neutralize acidic conditions of moisture in the dryer, and otherwise dramatically reduce lint production. This action likewise aids in increasing the effectiveness of the lint trap unit 10 and its operation, providing an essentially lint-free air flow from the system. The above disclosure sets forth in complete detail the concept of the generation of ionized air flow which is directed in to the interior of a fabric dryer for the purpose, inter alia, of drastically reducing and neutralizing acidic conditions in the dryer. The ionization unit or negative-ion generator 33 ionizes gaseous air constituents to produce the desired negative ions to effect the above result.

While particular embodiments have been shown and described, it will be obvious to those skilled in the art that various changes and modification may be made and, therefore, the aim in the appended claims is to cover all such changes as fall within the true spirit and scope of the invention.

We claim the following:

1. A fabric dryer system including, in combination, negative-ion-generating first means, including an ionization chamber provided with solely negatively charged ionization structure, for receiving ambient air and exhausting under pressure through said ionizing chamber substantially negatively ionized air flow for neutralizing acidic conditions in a dryer unit and reducing the production of lint therein; a fabric dryer unit having an air intake coupled to said first means for receiving said ionized air flow, said dryer unit including an air outlet for exhausting moisture-laden air from said dryer unit; and lint trap filter second means, having an inlet port coupled to said dryer air outlet and also an outlet port, for capturing lint entrained in air received by said second means, said second means outlet port exhausting to the exterior essentially lint-free air from said second means.

2. The dryer system of claim 1 wherein said second means outlet port is constructed for exhausting said essentially lint-free air to the interior of a building.

3. The dryer system of claim 1 wherein said second means outlet port is constructed for exhausting said essentially lint-free air to the exterior of a building.

4. The dryer system of claim 1 wherein said first means includes an alternating current electrical power input, third means coupled to said power input for generating a stepped-up direct current voltage, fourth means comprising a high-voltage negative DC elongated charging element coupled to said third means for creating an electrostatically charged environment within said first means, and an electrically powered fifth means for forcing said air flow through said environment.

5. The dryer system of claim 1 wherein said second means includes a slidable, essentially horizontally positioned, filter tray provided with a porous mesh, said inlet port of said second means being positioned beneath said filter tray, said outlet port of said second means being positioned above said filter tray.

6. An environmentally friendly system for treating fabric in acidic-moisture and static-electricity-conditioned environments, including, in combination: a fabric dryer unit for receiving and drying said fabric; first means, including an ionizing chamber having a solely unipolarity, negative, air-ionization element, for generating substantially negatively charged air and introducing said ionized air in said fabric dryer unit to neutralize acidic conditions and static electricity buildup as said fabric is progressively dried in said fabric dryer unit; and second means coupled to said fabric dryer unit to receive moisture-laden air exhaust therefrom and to substantially remove lint from said air exhaust, whereby said air exhaust can be exhausted to the exterior of said system essentially lint-free.

7. In combination: first means for effecting the generation of substantially negatively ionized, acid-neutralizing air flow, said first means having an ionization chamber including solely negatively-charged air-ionization structure; second, fabric dryer means, having an input coupled to said first means for receiving said ionized air flow, and also an outlet; and lint trap means coupled to said outlet for receiving and exhausting air flow received from said fabric dryer means to the exterior in an essentially lint-free condition.

* * * * *